US008544274B2

(12) United States Patent
Ernst

(10) Patent No.: US 8,544,274 B2
(45) Date of Patent: Oct. 1, 2013

(54) ENERGY RECOVERY SYSTEM USING AN ORGANIC RANKINE CYCLE

(75) Inventor: Timothy C Ernst, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 1043 days.

(21) Appl. No.: 12/508,190

(22) Filed: Jul. 23, 2009

(65) Prior Publication Data

US 2011/0016863 A1 Jan. 27, 2011

(51) Int. Cl.
*F01K 25/08* (2006.01)
*F01K 13/00* (2006.01)

(52) U.S. Cl.
USPC ..... 60/651; 60/653; 60/671; 60/676; 60/677

(58) Field of Classification Search
USPC ..... 60/651, 653, 671, 675, 677–680, 60/676
See application file for complete search history.

(56) References Cited

U.S. PATENT DOCUMENTS

| | | | | |
|---|---|---|---|---|
| 3,232,052 | A | 2/1966 | Ricard | |
| 3,789,804 | A | 2/1974 | Aguet | |
| 4,009,587 | A | 3/1977 | Robinson, Jr. et al. | |
| 4,164,850 | A | 8/1979 | Lowi, Jr. | |
| 4,204,401 | A | 5/1980 | Earnest | |
| 4,232,522 | A | 11/1980 | Steiger | |
| 4,267,692 | A | 5/1981 | Earnest | |
| 4,271,664 | A | 6/1981 | Earnest | |
| 4,428,190 | A | 1/1984 | Bronicki | |
| 4,458,493 | A | 7/1984 | Amir et al. | |
| 4,581,897 | A | 4/1986 | Sankrithi | |
| 4,630,572 | A | 12/1986 | Evans | |
| 4,831,817 | A | 5/1989 | Linhardt | |
| 4,873,829 | A | 10/1989 | Williamson | |
| 4,911,110 | A | 3/1990 | Isoda et al. | |
| 5,121,607 | A | 6/1992 | George, Jr. | |
| 5,207,188 | A | 5/1993 | Hama et al. | |
| 5,421,157 | A * | 6/1995 | Rosenblatt | 60/649 |
| 5,649,513 | A | 7/1997 | Kanda | |
| 5,685,152 | A | 11/1997 | Sterling | |
| 5,771,868 | A | 6/1998 | Khair | |
| 5,806,322 | A | 9/1998 | Cakmakci et al. | |
| 5,915,472 | A | 6/1999 | Takikawa et al. | |

(Continued)

FOREIGN PATENT DOCUMENTS

| | | |
|---|---|---|
| EP | 1 273 785 B1 | 5/2007 |
| JP | 60-222511 A | 11/1985 |

(Continued)

OTHER PUBLICATIONS

Notification of Transmittal of the International Search Report and the Written Opinin of the International Searching Authority, or the Declaration dated Feb. 23, 2011; International Application No. PCT/US2010/039630.

*Primary Examiner* — Hoang Nguyen
(74) *Attorney, Agent, or Firm* — Studebaker & Brackett PC

(57) ABSTRACT

A thermodynamic system for waste heat recovery, using an organic rankine cycle is provided which employs a single organic heat transferring fluid to recover heat energy from two waste heat streams having differing waste heat temperatures. Separate high and low temperature boilers provide high and low pressure vapor streams that are routed into an integrated turbine assembly having dual turbines mounted on a common shaft. Each turbine is appropriately sized for the pressure ratio of each stream.

18 Claims, 2 Drawing Sheets

(56) References Cited

U.S. PATENT DOCUMENTS

| | | | | |
|---|---|---|---|---|
| 5,950,425 | A | 9/1999 | Takahashi et al. | |
| 6,014,856 | A | 1/2000 | Bronicki et al. | |
| 6,035,643 | A | 3/2000 | Rosenblatt | |
| 6,055,959 | A | 5/2000 | Taue | |
| 6,128,905 | A | 10/2000 | Fahlsing | |
| 6,138,649 | A | 10/2000 | Khair et al. | |
| 6,301,890 | B1 | 10/2001 | Zeretzke | |
| 6,321,697 | B1 | 11/2001 | Matsuda et al. | |
| 6,324,849 | B1 | 12/2001 | Togawa et al. | |
| 6,393,840 | B1 | 5/2002 | Hay | |
| 6,494,045 | B2 | 12/2002 | Rollins, III | |
| 6,523,349 | B2 | 2/2003 | Viteri | |
| 6,571,548 | B1 | 6/2003 | Bronicki et al. | |
| 6,598,397 | B2 | 7/2003 | Hanna et al. | |
| 6,606,848 | B1 | 8/2003 | Rollins, III | |
| 6,637,207 | B2 | 10/2003 | Konezciny et al. | |
| 6,701,712 | B2 | 3/2004 | Bronicki et al. | |
| 6,715,296 | B2 | 4/2004 | Bakran et al. | |
| 6,745,574 | B1 | 6/2004 | Dettmer | |
| 6,748,934 | B2 | 6/2004 | Natkin et al. | |
| 6,751,959 | B1 | 6/2004 | McClanahan et al. | |
| 6,792,756 | B2 | 9/2004 | Bakran et al. | |
| 6,810,668 | B2 | 11/2004 | Nagatani et al. | |
| 6,817,185 | B2 | 11/2004 | Coney et al. | |
| 6,848,259 | B2 | 2/2005 | Keller-Sornig et al. | |
| 6,857,268 | B2 * | 2/2005 | Stinger et al. | 60/651 |
| 6,877,323 | B2 | 4/2005 | Dewis | |
| 6,880,344 | B2 | 4/2005 | Radcliff et al. | |
| 6,910,333 | B2 | 6/2005 | Minemi et al. | |
| 6,964,168 | B1 | 11/2005 | Pierson et al. | |
| 6,977,983 | B2 | 12/2005 | Correia et al. | |
| 6,986,251 | B2 | 1/2006 | Radcliff et al. | |
| 7,007,487 | B2 | 3/2006 | Belokon et al. | |
| 7,028,463 | B2 | 4/2006 | Hammond et al. | |
| 7,044,210 | B2 | 5/2006 | Usui | |
| 7,069,884 | B2 | 7/2006 | Baba et al. | |
| 7,117,827 | B1 | 10/2006 | Hinderks | |
| 7,121,906 | B2 | 10/2006 | Sundel | |
| 7,131,259 | B2 | 11/2006 | Rollins, III | |
| 7,131,290 | B2 | 11/2006 | Taniguchi et al. | |
| 7,159,400 | B2 | 1/2007 | Tsutsui et al. | |
| 7,174,716 | B2 | 2/2007 | Brasz et al. | |
| 7,174,732 | B2 | 2/2007 | Taniguchi et al. | |
| 7,191,740 | B2 | 3/2007 | Baba et al. | |
| 7,200,996 | B2 | 4/2007 | Cogswell et al. | |
| 7,225,621 | B2 | 6/2007 | Zimron et al. | |
| 7,281,530 | B2 | 10/2007 | Usui | |
| 7,325,401 | B1 | 2/2008 | Kesseli et al. | |
| 7,340,897 | B2 | 3/2008 | Zimron et al. | |
| 7,454,911 | B2 | 11/2008 | Tafas | |
| 7,469,540 | B1 | 12/2008 | Knapton et al. | |
| 7,578,139 | B2 | 8/2009 | Nishikawa et al. | |
| 7,665,304 | B2 | 2/2010 | Sundel | |
| 7,721,552 | B2 | 5/2010 | Hansson et al. | |
| 7,797,940 | B2 | 9/2010 | Kaplan | |
| 7,823,381 | B2 | 11/2010 | Misselhorn | |
| 7,833,433 | B2 | 11/2010 | Singh et al. | |
| 7,866,157 | B2 | 1/2011 | Ernst et al. | |
| 7,942,001 | B2 * | 5/2011 | Radcliff et al. | 60/651 |
| 7,958,873 | B2 | 6/2011 | Ernst et al. | |
| 7,997,076 | B2 | 8/2011 | Ernst | |
| 2002/0099476 | A1 | 7/2002 | Hamrin et al. | |
| 2003/0033812 | A1 | 2/2003 | Gerdes et al. | |
| 2003/0213245 | A1 | 11/2003 | Yates et al. | |
| 2003/0213246 | A1 * | 11/2003 | Coll et al. | 60/653 |
| 2003/0213248 | A1 | 11/2003 | Osborne et al. | |
| 2004/0088993 | A1 | 5/2004 | Radcliff et al. | |
| 2005/0262842 | A1 | 12/2005 | Claassen et al. | |
| 2008/0289313 | A1 | 11/2008 | Batscha et al. | |
| 2009/0031724 | A1 | 2/2009 | Ruiz | |
| 2009/0090109 | A1 | 4/2009 | Mills et al. | |
| 2009/0121495 | A1 | 5/2009 | Mills | |
| 2009/0133646 | A1 | 5/2009 | Wankhede et al. | |
| 2009/0151356 | A1 | 6/2009 | Ast et al. | |
| 2009/0179429 | A1 | 7/2009 | Ellis et al. | |
| 2009/0211253 | A1 | 8/2009 | Radcliff et al. | |
| 2009/0320477 | A1 | 12/2009 | Juchymenko | |
| 2009/0322089 | A1 | 12/2009 | Mills et al. | |
| 2010/0018207 | A1 | 1/2010 | Juchymenko | |
| 2010/0071368 | A1 * | 3/2010 | Kaplan et al. | 60/651 |
| 2010/0083919 | A1 | 4/2010 | Bucknell | |
| 2010/0139626 | A1 | 6/2010 | Raab et al. | |
| 2010/0180584 | A1 | 7/2010 | Berger et al. | |
| 2010/0192569 | A1 | 8/2010 | Ambros et al. | |
| 2010/0229525 | A1 | 9/2010 | Mackay et al. | |
| 2010/0257858 | A1 | 10/2010 | Yaguchi et al. | |
| 2010/0263380 | A1 * | 10/2010 | Biederman et al. | 60/651 |
| 2010/0282221 | A1 | 11/2010 | Le Lievre | |
| 2010/0288571 | A1 | 11/2010 | Dewis et al. | |
| 2011/0005477 | A1 | 1/2011 | Terashima et al. | |
| 2011/0006523 | A1 | 1/2011 | Samuel | |
| 2011/0094485 | A1 | 4/2011 | Vuk et al. | |
| 2011/0209473 | A1 | 9/2011 | Fritz et al. | |
| 2012/0023946 | A1 | 2/2012 | Ernst et al. | |

FOREIGN PATENT DOCUMENTS

| | | | |
|---|---|---|---|
| JP | H08-68318 | A | 3/1996 |
| JP | 9-32653 | A | 2/1997 |
| JP | 10-238418 | A | 9/1998 |
| JP | 11-166453 | A | 6/1999 |
| JP | 2002-115505 | A | 4/2002 |
| JP | 2005-36787 | A | 2/2005 |
| JP | 2005-42618 | A | 2/2005 |
| JP | 2005-201067 | A | 7/2005 |
| JP | 2005-329843 | A | 12/2005 |
| JP | 2007-332853 | A | 12/2007 |
| JP | 2008-240613 | A | 10/2008 |
| JP | 2009-167995 | A | 7/2009 |
| JP | 2009-191647 | A | 8/2009 |
| JP | 2010-77964 | A | 4/2010 |
| WO | 2009/098471 | A2 | 8/2009 |

* cited by examiner

ENERGY RECOVERY SYSTEM USING AN ORGANIC RANKINE CYCLE

STATEMENT REGARDING FEDERALLY SPONSORED RESEARCH OR DEVELOPMENT

This invention was made with government support under "Exhaust Energy Recovery," contract number DE-FC26-05NT42419 awarded by the Department of Energy (DOE). The government has certain rights in the invention.

FIELD OF THE INVENTION

The present invention generally relates to energy recovery from the waste heat of a prime mover machine such as an internal combustion engine.

BACKGROUND OF THE INVENTION

It is well known that the thermal efficiency of an internal combustion engine is very low. The energy that is not extracted as usable mechanical energy is typically expelled as waste heat into the atmosphere.

The greatest amount of waste heat is typically expelled through the engine's hot exhaust gas and the engine's coolant system.

SUMMARY OF THE INVENTION

The present invention teaches a thermodynamic system for waste heat recovery using an Organic Rankine Cycle (ORC) employing a single organic heat transferring fluid which economically increases the energy recovery from diesel engine waste heat streams of significantly different temperatures. Separate high and low temperature heat exchangers (boilers) provide boiled off, high and low pressure vapor streams that are routed into, preferably, an integrated turbine-generator, having dual turbines mounted on a common shaft. Each turbine is appropriately sized for the pressure ratio of each stream. Both turbines preferably vent to a common condenser through a common return conduit or fluid coupling whereby the vented fluid from the turbines is returned to the system.

DETAILED DESCRIPTION OF THE INVENTION

Figure 1:
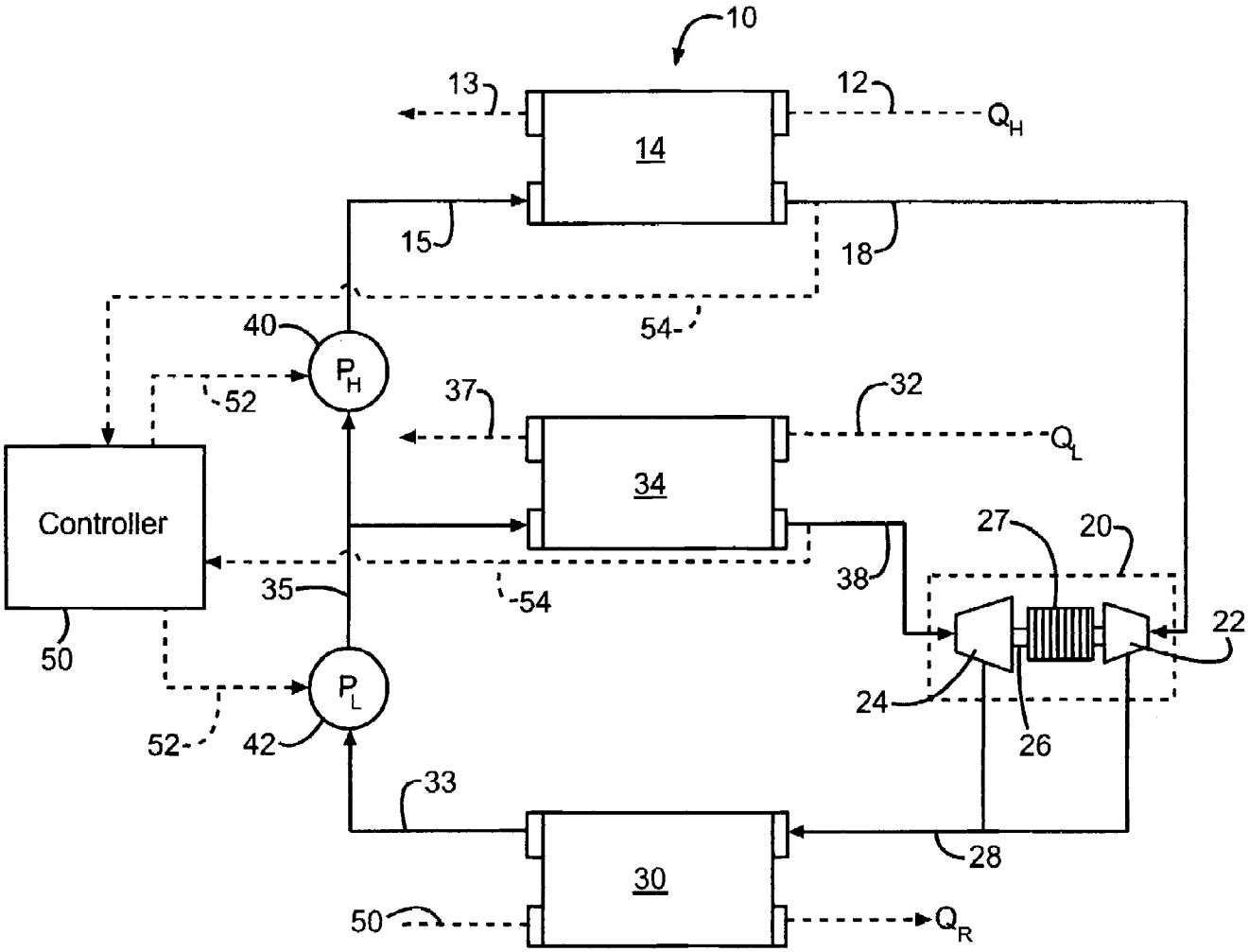
FIG. 1 presents a schematic diagram illustrating an exemplary embodiment of the present invention.

FIG. 1 presents a flow diagram of an Organic Rankine Cycle (ORC) system 10 having a single organic fluid, such as R-245fa, steam, fluorinol, toluene, ammonia, or any suitable refrigerant. ORC 10 generally comprises a high temperature heat exchanger or boiler 14, a low temperature heat exchanger or boiler 34 positioned in parallel to boiler 14, an integrated turbine-generator 20, and a condenser 30. A low pressure pump 42 supplies liquefied organic fluid, under a relatively low pressure (1100 kPa) to low temperature boiler 34 and to the suction port of a high pressure pump 40. High pressure pump 40 supplies organic fluid at a relatively high pressure (2000 kPa-3000 kPa) to high temperature boiler 14.

High Temperature Cycle:

A high temperature waste heat source $Q_H$ provides a high temperature heat conveying medium, such as the high temperature exhaust gases of an internal combustion diesel engine, to exhaust duct 12 for passing through boiler 14. Typically, depending upon engine loading, exhaust gases entering boiler 14 via exhaust duct 12 will range from 300 C-620 C, and exhaust gases exiting boiler 14 via exhaust passage 13 will range from 100 C-140 C. The exhaust waste heat $Q_H$ heats the high pressure liquefied organic fluid exiting from high pressure pump 40 and conveys it, by way of conduit 15, through high temperature boiler 14 thereby causing a phase change from a high pressure liquid into a high pressure gaseous stream exiting through conduit 18. The high pressure gaseous stream, exiting high temperature boiler 14, is conveyed, by way of conduit 18, to integrated turbine 20. The resulting cooled exhaust gas exiting boiler 14, through exhaust passage 13, is typically released into the atmosphere or an exhaust gas scrubber, or may be returned to the intake manifold as EGR (exhaust gas recirculation).

Integrated turbine 20 comprises a dual, high pressure turbine 22 and a low pressure turbine 24 mounted upon a common shaft 26. The common shaft may power or operate an electrical generator or any other desired device 27. Within integrated turbine 20, the high pressure gaseous stream from conduit 18 is passed through the high pressure turbine 22 thereby driving the device 27.

High-pressure turbine 22 and low pressure turbine 24 vent to a common fluid passage 28, which passes the exhausted and cooled gaseous stream into condenser 30. Condenser 30 further cools the exhausted stream thereby condensing the gaseous flow into a liquid phase. The liquid phase flow is conveyed by conduit 33 to the suction side of low pressure pump 42 at, for example, approximately 170 kPa-300 kPa. A stream of cooling medium, such as a cool air or water, is delivered to condenser 30 by conduit 50, and passed through condenser 30 at, for example, approximately 25 C-45 C thereby removing remaining waste heat $Q_R$ from the stream traveling through condenser 30.

Low Temperature Cycle:

Again referring to FIG. 1, the condensed organic fluid exiting condenser 30 through conduit 33 is directed to the suction port of low pressure pump 42. Upon exiting the discharge port of pump 42 as a relatively low pressure (1100 kPa) liquid phase organic fluid, conduit 35 then directs the liquefied fluid to the high pressure pump 40 intake port and also to low temperature boiler 34. The fluid exits low temperature boiler 34 and flows into conduit 38 as a relatively low pressure gaseous stream.

Similar to the high temperature cycle described above, a low temperature waste heat source $Q_L$ provides high temperature heat conveying medium, such as heated engine combustion air or "charge-air" provided by a compressor, to passage 32 for delivery to low temperature boiler 34. Waste heat $Q_L$, within boiler 34, heats the relatively low pressure liquid fluid flowing through boiler 34 causing a phase change from a low pressure liquid to the low pressure gaseous stream which flows into conduit 38. Thus low temperature boiler 34 also acts as an inter-cooler for the engine charge-air prior to entering the engine combustion cycle. The resulting cooled fluid, i.e., charge air, exits boiler 34 via passage 37 and is typically routed to the intake manifold of the engine.

The low pressure gaseous stream, exiting boiler 34, through conduit 38 is directed to integrated turbine 20, wherein the low pressure gaseous stream is expanded through low pressure turbine 24. Low pressure turbine 24 also vents to common fluid passage 28 wherein the combined discharge from turbines 22 and 24 is passed through condenser 30, exiting therefrom via conduit 33 as a cooled, liquefied fluid.

Figure 2:
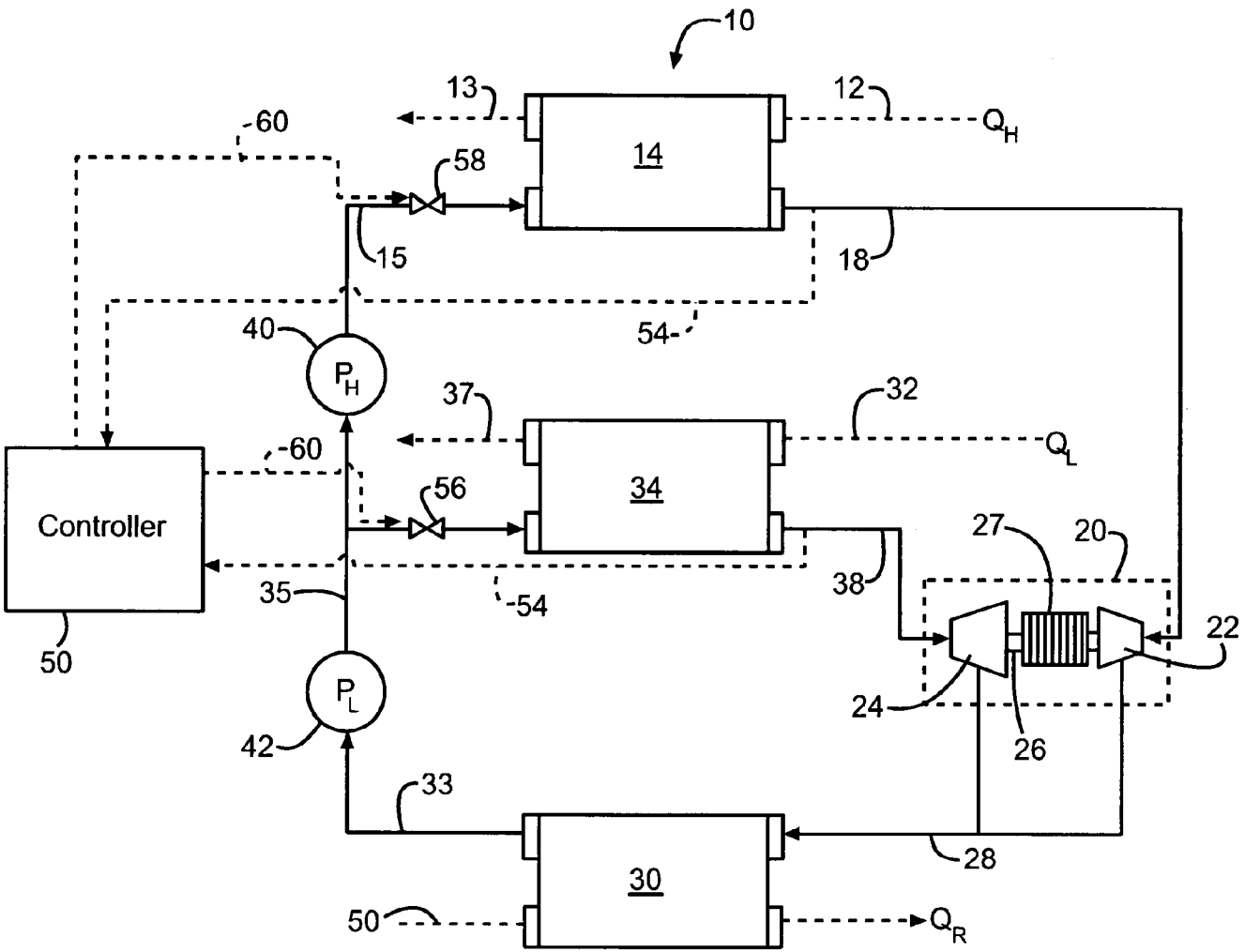
FIG. 2 presents a schematic diagram illustrating another exemplary embodiment of the present invention.

The system and method of the present invention may also include a control system adapted to permit control over the flow rate of fluid to and through each heat exchanger 14, 34. In the exemplary embodiment of FIG. 1, the control system includes the use of variable speed pumps, such as electric pumps, for high pressure pump 40 and low pressure pump 42. Also, a controller 50 receives signals indicative of, for example, the exit temperature of the fluid from the heat exchangers, determines and generates an appropriate control signal, and sends the control signal via lines 52 to one or both of pumps 40, 42 as appropriate, to control the speed of each pump and thus the flow rate of fluid to the heat exchangers based on, for example, a target superheat value of the vapor leaving the heat exchanger. In the exemplary embodiment of FIG. 1, temperature sensors may be positioned in the exit conduits 18, 38 for generating and sending signals to controller 50 via sensor lines 54. In an alternative embodiment shown in FIG. 2, the control system includes a low pressure flow control valve 56 and a high pressure flow control valve 58 positioned on the upstream side of the respective heat exchanger for controlling fluid flow into the respective heat exchanger. The controller 50 receives signals indicative of, for example, the exit temperature of the fluid from the heat exchangers, determines and generates an appropriate control signal, and sends the control signal via lines 60 to one or both of valves 56, 58 as appropriate, to control the position, i.e. degree of opening, of each valve and thus the flow rate of fluid to the heat exchangers based on, for example, a target superheat value of the vapor leaving the heat exchanger. In another embodiment, the system may include both the variable speed pumps and the flow control valves.

In general, during operation, the heat input to each heat exchanger would typically be in proportion to the other. Therefore when one heat exchanger has increasing heat input, the other heat exchanger would have increasing heat input. During periods of increasing heat input, the flow rate of organic fluid to each heat exchanger would need to be increased to accommodate the higher heat input and maintain a target superheat of the vapor leaving each heat exchanger. This can be done either by increasing the pump speed of one or both pumps 40, 42 or by opening the flow control valves 56, 58 upstream of respective heat exchangers to allow additional flow to the heat exchangers. When heat input is reduced for one heat exchanger, both heat exchangers would typically have a reduction in heat input and the flow rate of organic fluid would need to be reduced to prevent saturated liquid from entering the turbine expander. The flow rate to both heat exchangers is preferably regulated to prevent thermal breakdown of the working fluid due to excessive temperatures. This regulation can be achieved by increasing flow rate of the organic fluid to the particular heat exchanger. The flow rate also needs to be regulated to prevent saturated fluid from entering the turbine expander. This regulation can be done by reducing the flow rate to each heat exchanger as needed. Typically, the heat input to the low temperature heat exchanger would not be high enough to cause thermal breakdown of the fluid and thus the fluid flow rate can likely be reduced to zero flow rate without any degradation of the working fluid. This may be beneficial for cooling the high temperature heat source during high load operation of the engine.

The waste heat recovery system described above may be applied to an internal combustion engine to increase the thermal efficiency of the base engine. Waste heat streams at significantly different temperatures dictate different heat exchanger/boiler temperatures (i.e., different pressures) to maximize the energy recovery potential from each waste heat source. As discussed above, the present invention uses a single fluid at different pressures to extract heat from two waste heat streams by routing the boiled off vapor streams to an expander preferably having dual turbines and preferably mounted on a common shaft. Using the dual turbine assembly disclosed herein above allows the ability to economically recover heat from waste heat sources with a wide range of temperatures with a single rotating assembly that has dual turbines at different pressure ratios since each turbine is sized appropriately for the pressure ratio of each stream. Thus the present system and method allows lower costs and lower parasitic losses than using two separate turbines.

While we have described above the principles of our invention in connection with a specific embodiment, its to be clearly understood that this description is made only by way of example and not as a limitation of the scope of our invention as set forth in the accompanying claims.

I claim:

1. A method of recovering energy from dual sources of waste heat having differing temperatures using a single organic fluid, comprising:

a) providing a first waste heat source;

b) providing a second waste heat source, said second waste heat source having a temperature higher than said first waste heat source;

c) providing a first heat exchanger;

d) passing a first heat conveying medium from said first waste heat source through said first heat exchanger;

e) providing a first pump to pressurize said organic fluid to a first pressure;

f) passing said organic fluid through said first heat exchanger;

g) directing said organic fluid from said first heat exchanger through a first turbine;

h) directing the organic fluid from said first turbine through a cooling condenser;

i) providing a second pump positioned downstream of said cooling condenser to pressurize said organic fluid to a second pressure, said second pressure being greater than said first pressure;

j) providing a second heat exchanger;

k) passing a second heat conveying medium from said second waste heat source through said second heat exchanger;

l) passing the pressurized organic fluid, exiting said second pump, through said second heat exchanger; and m) directing said organic fluid from said second heat exchanger through a second turbine.

2. The method of claim 1, wherein said second turbine powers an associated device.

3. The method of claim 1, wherein said first and second turbines are mounted on a common shaft.

4. The method of claim 3, wherein said common shaft drives a generator.

5. The method of claim 1, wherein said second pump is positioned downstream of said first pump.

6. The method of claim 1, wherein said first turbine and said second turbine operate a common device.

7. The method of claim 1, further including controlling a flow rate of organic fluid to at least one of said first and said second heat exchangers.

8. The method of claim 1, further including sensing a temperature of said organic fluid exiting said at least one said first and said second heat exchangers and controlling said flow rate of said organic fluid based on said temperature.

9. A system for recovering energy from dual sources of waste heat having differing temperatures using a single organic fluid, comprising:

a) a first heat exchanger arranged to receive a heat transfer medium from a first waste heat source;

b) a first pump adapted to pressurize said organic fluid to a first pressure and convey said organic fluid through said first heat exchanger;

c) a first turbine positioned to receive said organic fluid from said first heat exchanger;

d) a common passage arranged to receive said organic fluid from said first turbine;

e) a cooling condenser arranged to receive said organic fluid from said common passage;

f) a second pump positioned downstream from said first pump to pressurize said organic fluid to a second pressure greater than said first pressure;

g) a second heat exchanger arranged to receive a heat transfer medium from a second waste heat source and to receive said organic fluid exiting said second pump; and h) a second turbine positioned to receive said organic fluid from said second heat exchanger.

10. The system of claim 9, wherein said first turbine operates a device.

11. The system of claim 9, wherein said first and second turbines are mounted on a common shaft.

12. The system of claim 11, wherein said common shaft drives a generator.

13. The system of claim 9, wherein said first and second turbines operate a common device.

14. The system of claim 9, further including a flow control system to control a flow rate of organic fluid to at least one of said first and said second heat exchangers.

15. The system of claim 14, wherein said first pump and said second pump are variable speed pumps, said flow control system including a controller adapted to generate control signals to control the speed of said first and said second pumps to control said flow rate of said organic fluid.

16. The system of claim 15, wherein said controller generates said control signals based on a temperature of said organic fluid exiting said first and said second heat exchangers.

17. The system of claim 14, wherein said flow control system includes a respective flow control valve positioned upstream of each of said first and said second heat exchangers, and a controller adapted to generate control signals to control a position of said flow control valves to control said flow rate of said organic fluid.

18. The system of claim 17, wherein said controller generates said control signals based on a temperature of said organic fluid exiting at least one of said first and said second heat exchangers.

* * * * *